United States Patent [19]

Ozeki et al.

[11] Patent Number: 4,987,947

[45] **Date of Patent: * Jan. 29, 1991**

[54] GAS VENTING DEVICE FOR MOLDING OPERATIONS

[75] Inventors: Mamoru Ozeki, Zama; Akihico Tsuda, Atsugi, both of Japan

[73] Assignee: Toshiba Kikai Kabushiki Kaisha, Tokyo, Japan

[ * ] Notice: The portion of the term of this patent subsequent to Nov. 29, 2005 has been disclaimed.

[21] Appl. No.: 276,810

[22] Filed: Nov. 28, 1988

Related U.S. Application Data

[63] Continuation-in-part of Ser. No. 58,777, Jun. 5, 1987, Pat. No. 4,787,436.

[51] Int. Cl.[5] ..... B22D 17/14

[52] U.S. Cl. ..... 164/305; 164/410; 425/420; 425/812

[58] Field of Search ..... 164/305, 410; 425/420, 425/812

[56] References Cited

U.S. PATENT DOCUMENTS 4,787,436 11/1988 Ozeki et al. ..... 164/305

*Primary Examiner*—Kuang Y. Lin

*Attorney, Agent, or Firm*—Banner, Birch, McKie & Beckett

[57] ABSTRACT

A gas venting device for molding operations is disclosed having a valve for closing off a gas evacuation system from a mold when the mold cavity is filled with melt. A positive drive mechanism is provided for closing the valve, and a mechanism is provided for allowing the valve body to close more rapidly by action of the melt itself against the valve body in the event the melt advances more rapidly.

6 Claims, 12 Drawing Sheets

GAS VENTING DEVICE FOR MOLDING OPERATIONS

RELATED APPLICATION

This application is a continuation-in-part of copending patent application Ser. No. 07/058,777, filed June 5, 1987, now U.S. Pat. No. 4,787,436.

BACKGROUND OF THE INVENTION

This invention relates to a gas venting arrangement for use with a molding machine, such as one used in die-casting operations.

In die-casting operations a quantity of molten metal is injected into a die cavity which has a shape corresponding to the shape of the final die-cast product. In order to ensure a substantially void-free die casting, the mold cavity is placed under vacuum throughout the melt injection process to remove as much gaseous material as possible from the mold cavity. One type of commonly used gas evacuation or venting arrangement incorporates a shut-off valve for controlling gas flow out of the mold cavity through a gas vent passage. The valve remains open during injection and, when the mold cavity is filled with melt, the valve closes to prevent the vacuum source from ingesting any excess melt which may flow out of the mold and through the gas vent passage.

Valved gas venting devices of the prior art generally are of two types, both typically involving a reciprocating valve body which cooperates with an annular seat. In one type the movement of the valve body to its closed position is accomplished by a positive drive mechanism which is synchronized with melt injection so as to close when the mold cavity is full. Morton, U.S. Pat. No. 3,121,926, discloses one example of this type of arrangement wherein a trigger switch actuated by the injection ram initiates valve closure. Thurner, U.S. Pat. No. 4,463,793 discloses another example of this type of arrangement. These types of positively driven gas vent valves, while effective, are not foolproof, inasmuch as rapidly advancing melt in some instances may reach the valve body before it is completely closed, thereby fouling the valve and seat, preventing full closure and clogging the evacuation system.

The other type of valve arrangement used in the prior art involves a melt-driven valve body wherein movement of the valve body to its closed position is effected by pressure of dynamic forces exerted by the melt itself directly on the valve body. In many situations, such as that disclosed by Takeshima, U.S. Pat. No. 4,431,047, the valve body is spring-biased to its open position, dynamic melt forces supposedly being sufficient to overcome the spring force and move the valve body to its closed position. However, as recognized by Takeshima in his later U.S. Pat. No. 4,489,771, such an arrangement is not foolproof because the valve body can oscillate due to serial impingement of discontinuous melt (i.e. having one or more voids) which momentarily relieves pressure on the valve body and allows it to re-open. Momentary opening of the valve in the presence of the melt can lead to fouling of the sealing surfaces and invasion of melt into the evacuation chamber. Accordingly, Takeshima in U.S. Pat. No. 4,489,771 provides a complex biasing and triggering mechanism which reverses the bias on the valve body (i.e. towards its closed position) upon initial impingement of the melt. While this arrangement may preclude valve body oscillation, it is not clear whether the closing spring force on the valve body is sufficient in all instances to seal the valve body against the valve seat if some melt has reached the valve seat and interferes with closure. Hodler, U.S. Pat. No. 3,885,618 discloses a melt-actuated valve body which floats freely in the valve chamber (when the mold is closed). Hodler relies on the configuration of the valve body to make an effective seal when it retracts within the seat, but there is no guarantee that the pressure of the melt itself acting on the valve body can overcome any obstruction that may be present between the sealing surfaces caused by solidified melt which may have splashed past the valve body and into the seat.

SUMMARY OF THE INVENTION

It is, therefore, an object of the present invention to overcome the above-noted and other shortcomings and disadvantages of the prior art by providing a gas venting device for molding operations which reliably isolates the vacuum system from the mold cavity when the mold cavity is filled with melt with virtually no invasion of melt into the evacuation system prior to valve closure.

Another object of the invention is to provide such a gas venting device having a positive valve closure mechanism which will overcome any obstruction between the valve body and valve seat.

Another object of the invention is to provide such a gas venting device wherein the valve body is more rapidly advanced toward closure by the melt itself if melt advancing through the gas vent passage overtakes the positively driven valve body, virtually precluding invasion of melt into the evacuation system under all circumstances.

A further object of the present invention is to provide such a gas venting device in which it is easy to eliminate hardened metal from the device even if the melt has entered into the gas vent passage.

These and other objects of the invention are accomplished by a gas venting arrangement for use with molding apparatus including a mold having a cavity to be filled with melt, means for injecting melt into the mold cavity and a gas vent passage communication with the mold cavity for evacuating gas from the mold cavity ahead of advancing melt as it fills the mold cavity. The gas venting arrangement comprises a housing having a valve chamber with an inlet adapted to be placed in fluid communication with the gas vent passage, and an exhaust port for evacuating gas from the valve chamber. An annular valve seat with an inclined surface adjacent the inlet cooperates with a valve body coaxial with the valve chamber and the valve seat, the valve body having a valve stem extending rearwardly through the valve chamber away from the mold. The valve body has an inclined surface according to the surface of the valve seat and is axially movable forwardly, toward the mold, to open the inlet, and movable rearwardly, away from the mold, to close the inlet in cooperation with the valve seat. A pair of detectors are provided, one of which detects when a ram for injecting melt reaches a predetermined position within its stroke and generates a signal according to such detection. Valve actuation means is associated with the housing and is operatively coupled to the valve stem for positively driving the valve body rearwardly to positively close the inlet when the mold is full of melt, and permitting the valve body to be driven rearwardly more rapidly by the melt itself to close the inlet if melt advancing through the gas vent passage overtakes the positively driven valve body.

Preferably, the valve actuation means also positively drives the valve body forwardly to forcibly open the inlet before melt is injected into the mold cavity. This may include a double-acting fluid cylinder and piston assembly acting on a reciprocable drive member which is operatively coupled to the valve stem. The coupling arrangement provides for free valve body movement between the open and closed position when the fluid cylinder is not pressurized. This enables the operator to check for obstruction when the mold is open, and permits the valve body to be driven toward closure more rapidly by the melt itself than it is by the fluid cylinder and piston assembly in the event the advancing melt overtakes the valve body.

BRIEF DESCRIPTION OF THE DRAWING

Other features and advantages of the invention can be more fully understood from the following detailed description of a preferred embodiment taken in conjunction with the accompanying drawings, in which.

DETAILED DESCRIPTION

Figure 1:
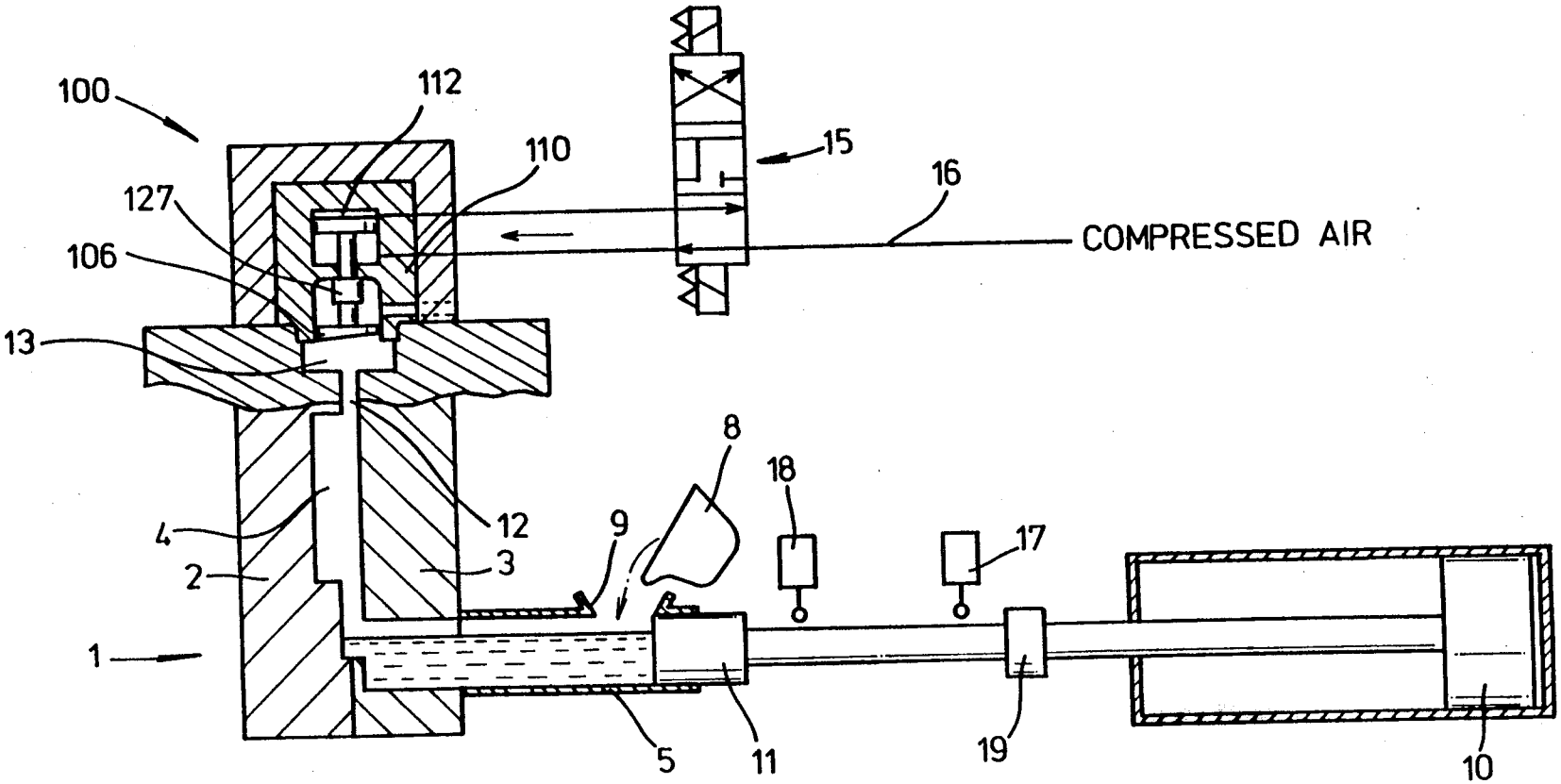
FIGS. 1, 2, 3 and 4 are schematic representations of die-casting apparatus incorporating the gas venting device according to the invention, showing progressive phases of the die-casting and gas venting operation.

Referring the FIGS. 1 through 4, die casting apparatus is schematically shown which comprises a die or mold 1 having stationary and movable mold sections 2, 3, respectively, which define a mold cavity 4 therebetween. An injection chamber 5 communicates with mold cavity 4 through an inlet passage 6. Injection chamber 5 is charged with molten metal 7 from a crucible 8 or other source of melt through funnel 9. An injection ram 10 drives an injection piston 11 through injection chamber 5 to force melt 7 into mold cavity.

A gas venting device 100 according to the invention and associated evacuation equipment serve to remove gasses from mold cavity 4 during injection process through a gas vent passage 12. As seen more clearly in FIGS. 5, 6, and 7, gas vent passage 12 communicates with a chamber 13 into which a valve body 106 can enter, as illustrated hereinafter. A pair of small passages 14-14 are provided at the sides of the chamber 13 which communicate with a space defined around valve stem 126. As seen from the drawings, valve body 106 has an inclined surface 106*a* at the bottom thereof. At its upper side, a stopper means in the form of a flange 127 is provided. The outer diameter of the stopper 127 is a little less than that of the inside wall of the chamber defined within the valve seat 104, and the stopper 127 can prevent powder from the melt and/or dust from entering the coupling chamber 122. The stopper 127 also acts to reduce the impinging force per unit area against the top inside surface of the valve seat since it has a large surface area. A valve chamber 102 houses a valve seat 104 which cooperates at its lower end with a reciprocable valve body 106 to open and close a gas inlet 108 at the lower end of valve chamber 102. The gas inlet 108 is defined to be inclined at its end portion, corresponding to the surface 106*a* of valve body 106. A gas evacuation port 110 is connected to a vacuum or reduced pressure source (not shown) for drawing gases through gas vent passages 12, chamber 13, passage 14-14 and inlet 108 when valve body 106 is in its lower or open position, blocking the upper end of main gas vent passage 14. Valve body 106 is connected as described below to a pneumatic cylinder and piston assembly 112 which effects forward (i.e., toward the mold) and rearward (i.e., away form the mold) movement of valve body 106 to open or close inlet 108.

Referring again to FIGS. 1, 2, 3 and 4, pneumatic cylinder and piston assembly 112 is controlled through a solenoid valve 15 connected at 16 to a source of compressed air. The position of solenoid valve 15 is determined by a control circuit incorporating limit switches 17 and 18 which sense a predetermined position of injection piston 11 by interaction with cam 19 located on the drive shaft of injection ram 10.

Figure 2:
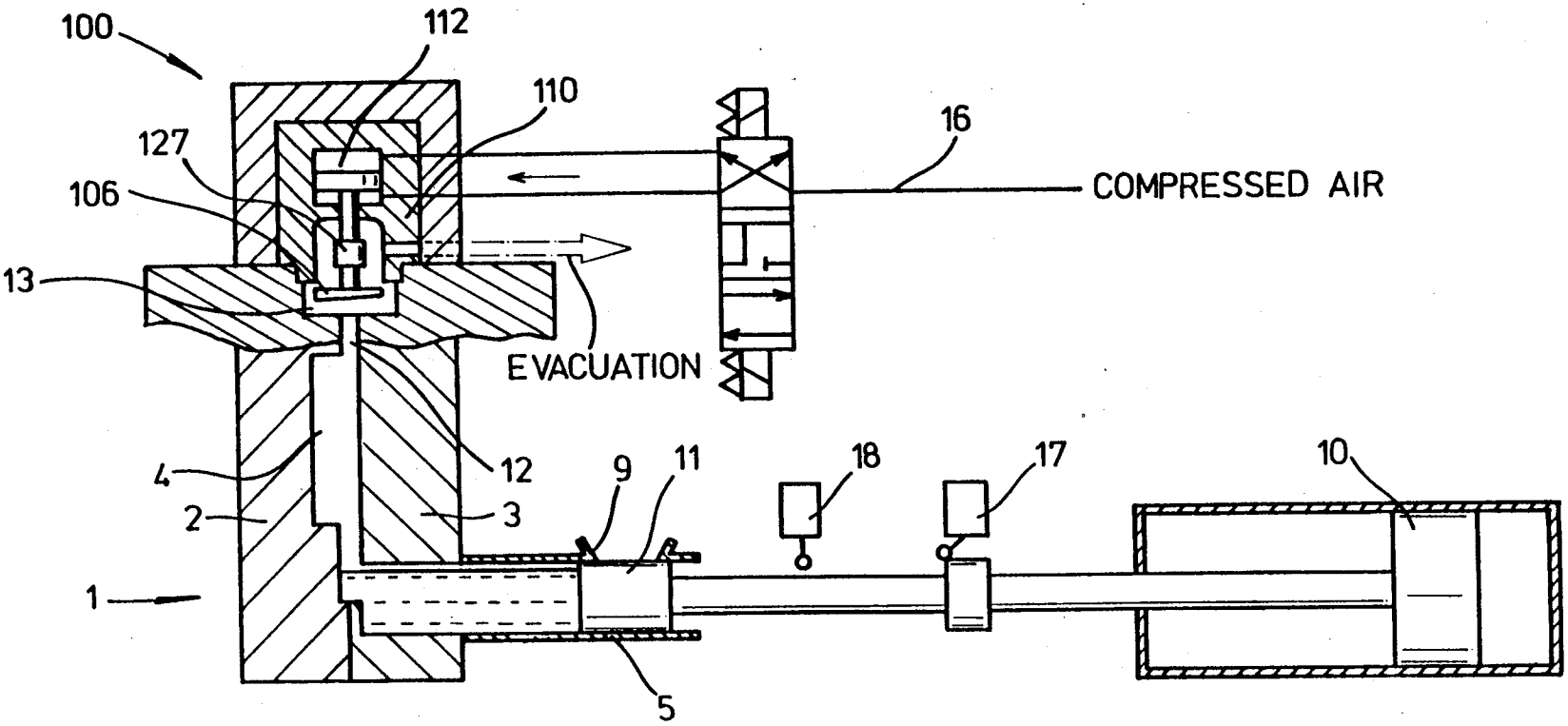

The molding or die-casting operation now will be generally described with reference to FIGS. 1 through 4. FIG. 1 illustrates the configuration of the system just prior to injection of melt into mold cavity 4. First the solenoid valve is activated as shown in FIG. 1 for thereby positioning the valve body 106 at its upper (i.e. closed) position through compressed air supplied from source 16 to a pneumatic cylinder and piston assembly 112. Then, an injection process is manually initiated. The injection ram 10 moves toward the left side, as shown in FIG. 1, through the injection chamber. Accordingly, the piston 11 delivers the melt 7 in the injection chamber 5 to the cavity 4. Upon further movement of the ram 10 toward the left side, the cam 19 engages with the limit switch 17 to generate a signal. An output signal from the limit switch 17 activates a vacuum system (not shown) and causes the solenoid valve 15 to be actuated. As shown in FIG. 2, the solenoid valve 15 is turned and the compressed air from the source 16 moves the piston of the pneumatic cylinder and piston assembly 112 downwardly, as shown in the figures, for thereby forwardly moving the valve body 106. Thus, air and/or gasses within the cavity 4, vent passage 12, chamber 13 and passages 14-14 are evacuated by means of the vacuum system (not shown). Proximity switch 152 detects when the piston of the pneumatic cylinder and piston assembly 112 reaches its most forward position, and initiates the operation of a counter (not shown). During counting, the cylinder and piston assembly 112 maintains the vent passage 12 closed by means of the valve body 106.

Figure 3:
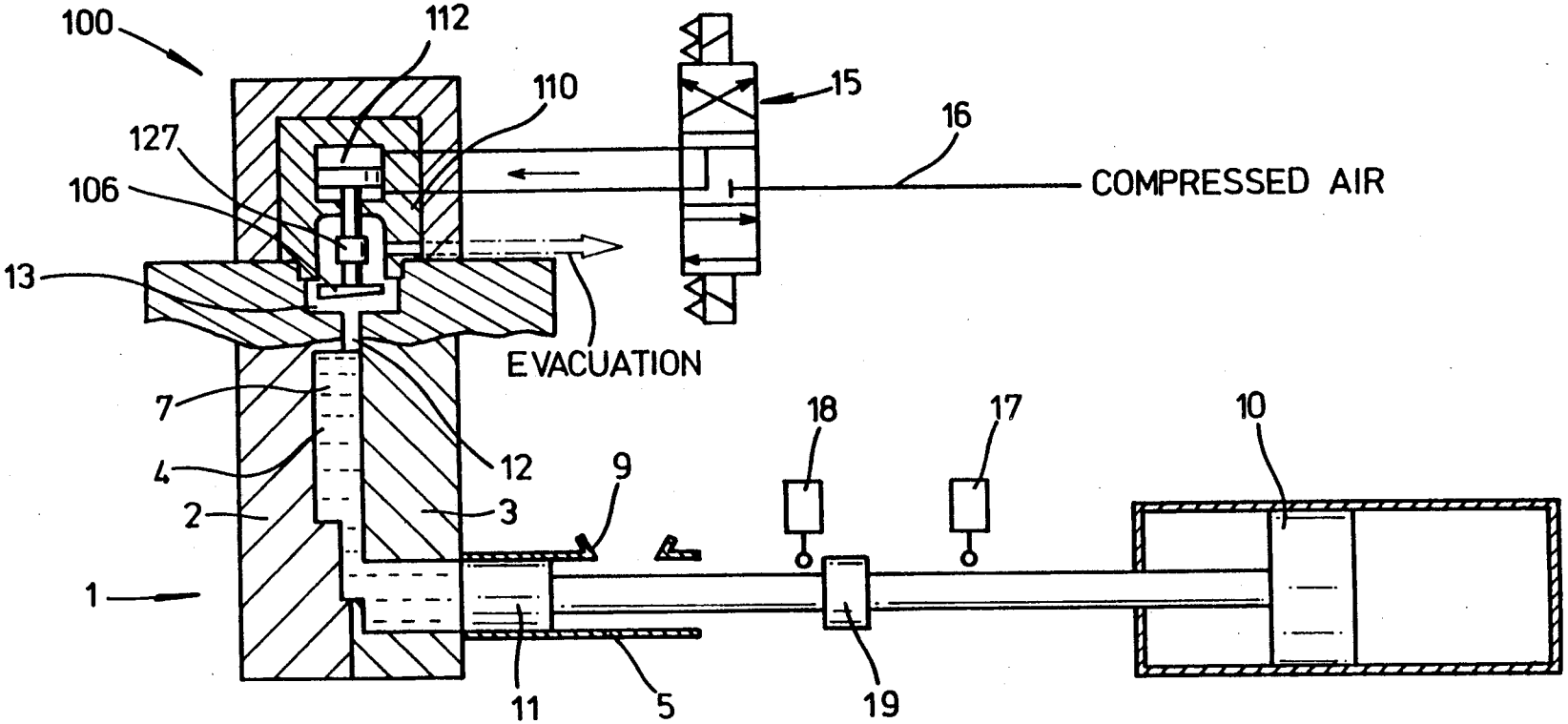
Figure 4:
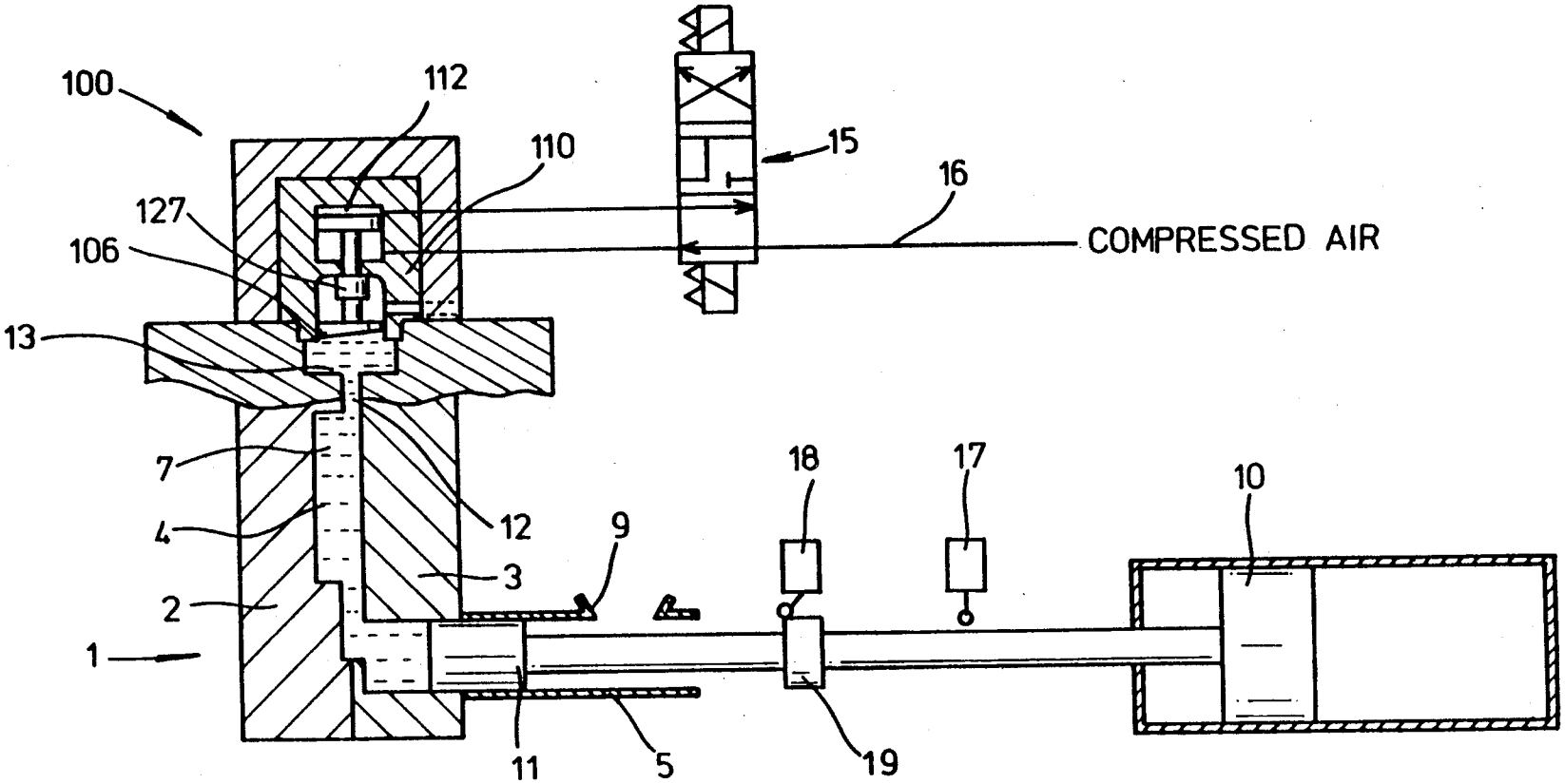

When counting is terminated, a count-up signal deactivates the solenoid valve 15 for thereby allowing the solenoid valve to assume its neutral position. Therefore, the valve body 106 is kept open, and the valve body can move as rapidly as possible to close the passage or inlet even when the melt may enter through the passages 14-14. During this time, the cam 19 is located between the limit switches 17 and 18 as illustrated in FIG. 3. The piston 11 moves further leftwardly so that the cam 19 engages the limit switch 18. Consequently, an output signal from the limit switch 18 is supplied to the solenoid valve 15 to turn it as indicated in FIG. 4. Accordingly, the cylinder-piston assembly 112 moves rearwardly, and thereby the valve body 106 reaches the valve seat 104 and the exhaust post 110 is disconnected from the passage 12. In other words, the valve body 106 disturbs communication between the exhaust port 110 and the passage 12 when the stopper abuts the uppermost portion of the valve seat 106. As seen from the drawings, by means of adjustment bolts 130-130, the position of the valve seat 104 can be adjusted since seat blocks 128-128 are displaced along the slanted surfaces of the the valve seat 104.

Prior to the melt entering into the valve chamber 102 through gas vent by-pass passage 13, the valve body sufficiently closes the inlet 108.

Once molding has been completed, movable die portion 3 is opened, the molded part is removed and excess melt is cleared from the gas vent passages and the lower face of valve body 106. With solenoid valve 15 in the position illustrated in FIG. 1, compressed air supplied at 16 again will force valve body 106 downwardly to its open position, facilitating cleaning of the valve body and adjacent surfaces. With cleaning complete and the mold reassembled, the molding process then may be repeated.

Figure 5:
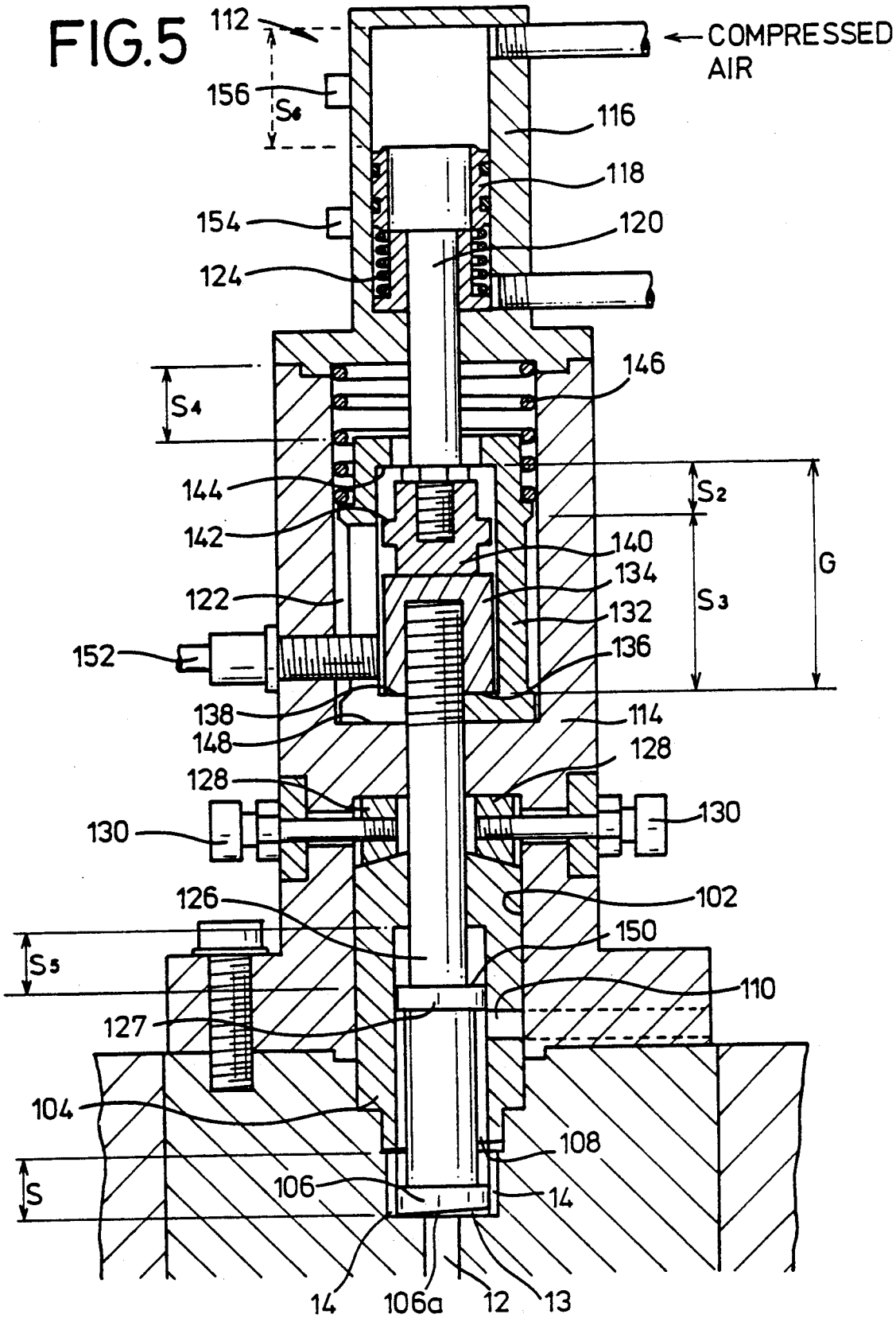
FIGS. 5, 6, and 7 are vertical sectional views of the gas venting device according to the invention shown in different phases of the die-casting and gas evacuation operation.
Figure 6:
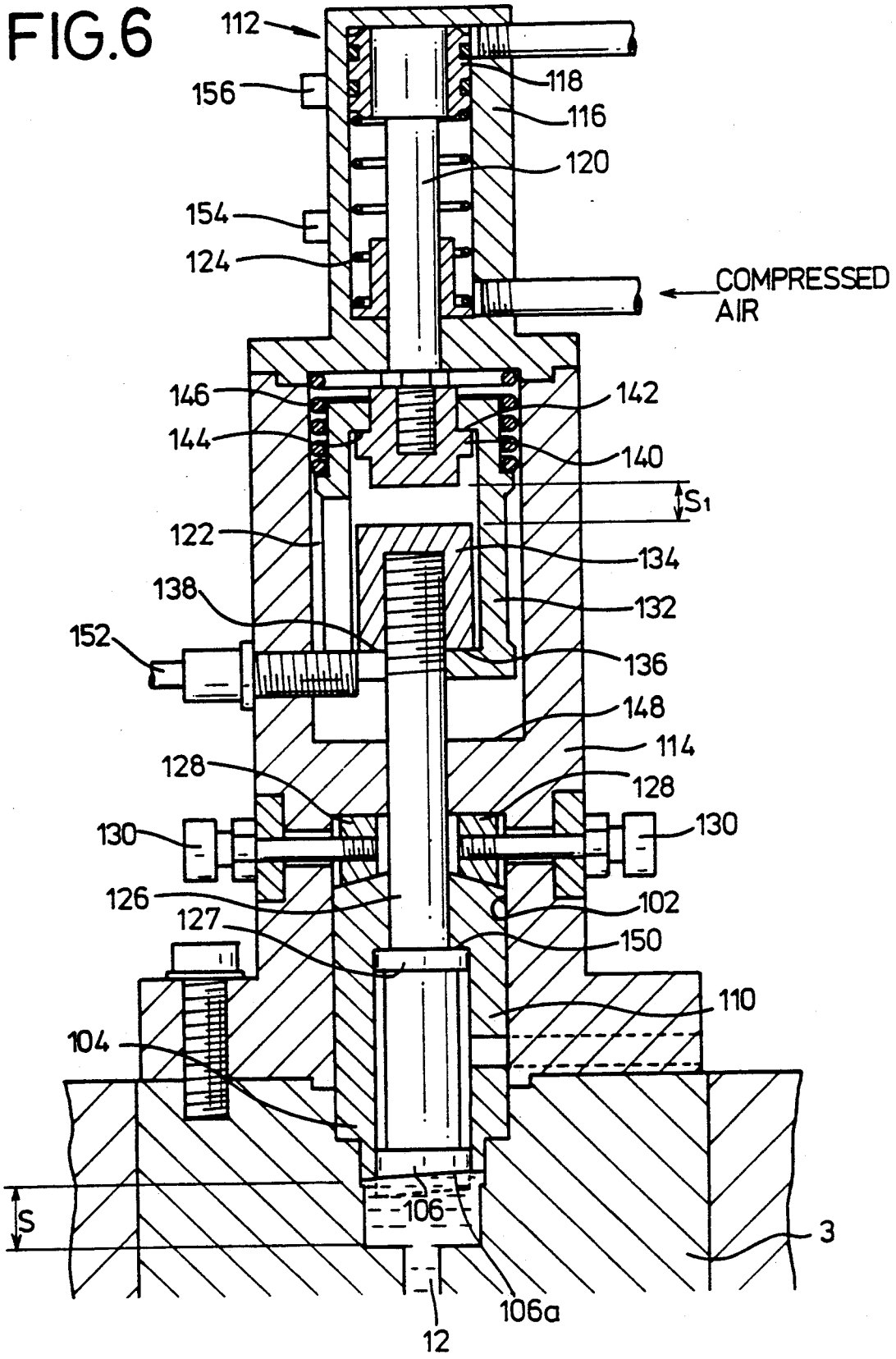
Figure 7:
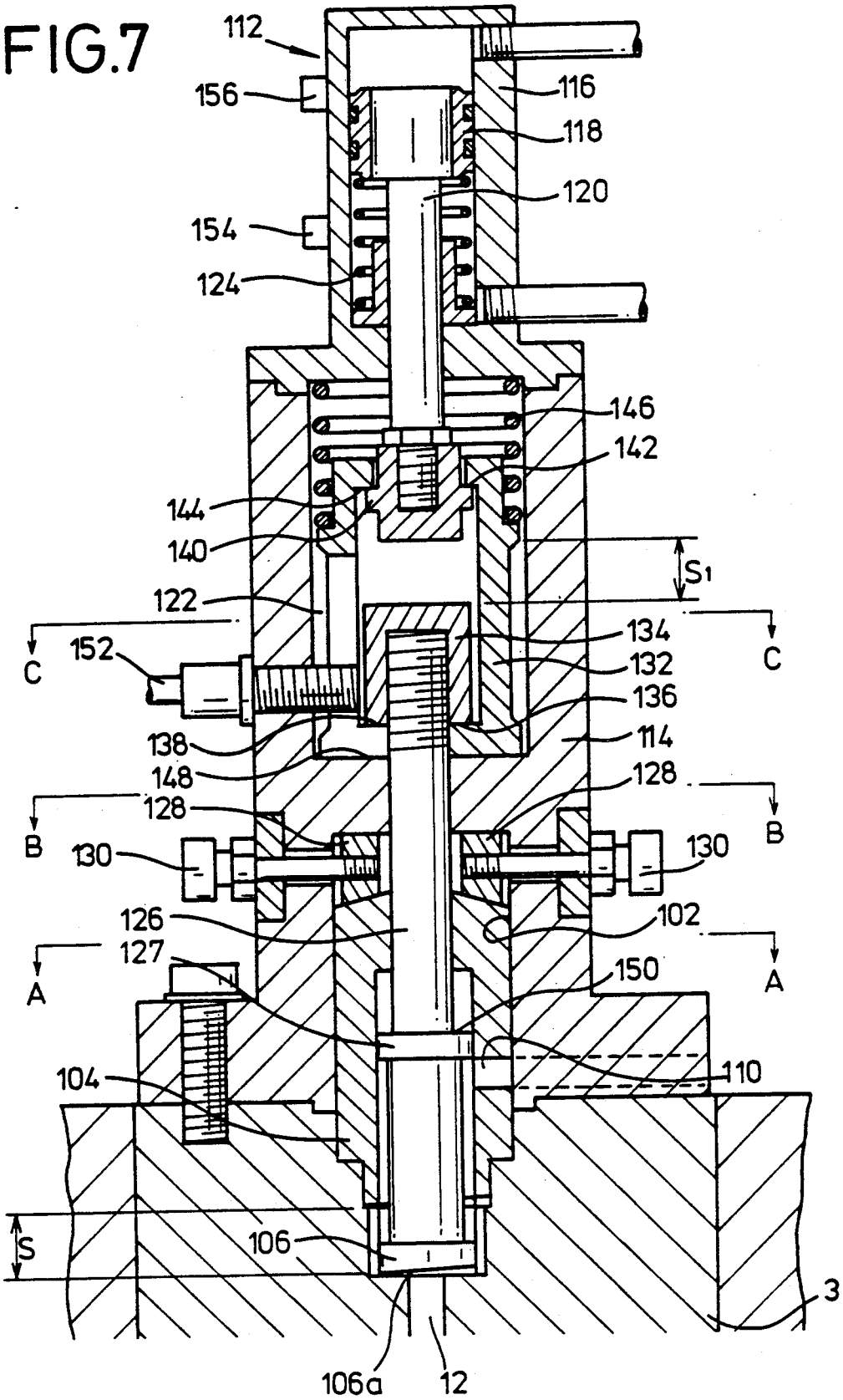

Referring to FIGS. 5, 6, and 7, the gas venting device according to the invention now will be described in detail. Valve chamber 102 is contained within a housing 114, at the top or rear end of which is located pneumatic cylinder and piston assembly 112. This assembly comprises a cylinder 116 housing a piston 118 which is connected to a drive member or rod 120 extending forwardly into a coupling chamber 122. A piston-engaging coil spring 124 within cylinder 116 exerts a rearward bias on piston 118 and drive rod 120. Valve body 106 is mounted at the end of a valve stem 126 which extends rearwardly through valve chamber 102 into coupling chamber 122. The position of valve seat 104 is adjustable by means of tapered seat adjusting blocks 128 which can be externally manipulated by means of adjusting screws 130.

Drive rod 120 and valve stem 126 are coaxial and their distal ends are coupled by a sliding joint 132 located in coupling chamber 122. A valve stem nut 134 is threaded onto the end of valve stem 126 and has a forwardly facing shoulder 136 which cooperates with a rearwardly facing shoulder 138 at the forward end of sliding joint 132. Similarly, a drive rod nut 140 threaded onto the end of drive rod 120 has a rearwardly facing shoulder 142 which is adapted to mate with a forwardly facing shoulder 144 at the rear end of sliding joint 132. A joint-engaging coil spring 146 in coupling chamber 122 exerts a forward bias on sliding joint 132 toward its foremost position against the front end 148 of coupling chamber 122. The forward biasing force of spring 146 is greater than the rearward biasing force of spring 124. Thus, with the valve body 106 is its foremost or open position and cylinder 116 unpressurized, the working parts are in the configuration shown in FIG. 7, with a spacing $S_1$ between the ends of valve stem nut 134 and drive rod nut 140. In this "check" position valve body 106 and valve stem 126 are freely movable, which allows the operator to manually check the freedom of movement of valve body 106 before the mold is reclosed for further molding.

The sizing and spacing of the various working components of the gas venting device preferably is as follows. Valve body 106 (and valve stem 126) must undergo a stroke S defined by the fully open position shown in FIGS. 5 and 7 (blocking main gas vent passage 14) and the fully closed position shown in FIG. 6 (retracted within valve seat 104). Stated otherwise, the valve body 106 closes the gas vent passage 14 when the valve body is in a position as shown in FIGS. 5 and 7, while the valve body 106 moves toward the valve seat 104 so that the valve body 106 sufficiently closes. The shoulder 150 on valve stem 126 is located at a spacing $S_5$ from the rear end of valve seat 102 with the valve in the open position, where $S_5$ is equal to or greater than stroke S. This spacing of course allows valve body 106 to move through a complete stroke when closing. Similarly, with sliding joint 132 in its foremost position (see FIG. 4), the spacing $S_4$ between its rear end and the rear end of joint chamber 122 must be equal to or greater than stroke S. This also holds true for the spacing $S_6$ between the rear end of piston 118 and the rear end of cylinder 116, since rearward movement of piston 118 causes drive rod nut 140 to lift sliding joint 132 and, in turn, lift valve stem nut 134 along with valve stem 126 and valve body 106. Gap G between the front and rear shoulder 138, 144 of sliding joint 132 must exceed the minimum spacing between shoulder 142 on drive rod nut 140 and shoulder 136 on valve stem nut 134 ($S_3$) by a distance $S_2$ which is at least equal to stroke S. Of course, spacing $S_1$ (FIG. 6) must equal spacing $S_2$.

Certain ancillary control elements may be used to provide data on the position of certain working parts of the gas venting device, which can be utilized for automatic control, if desired. Thus, a magnetic or optical position sensor 152 detects the position of valve stem nut 134, while magnetic limit switches 154,156 detect the position of piston 118 within cylinder 116. Other position detectors and controllers may be provided as necessary for indicating the condition of the various working elements of the gas venting device.

Figure 8C:
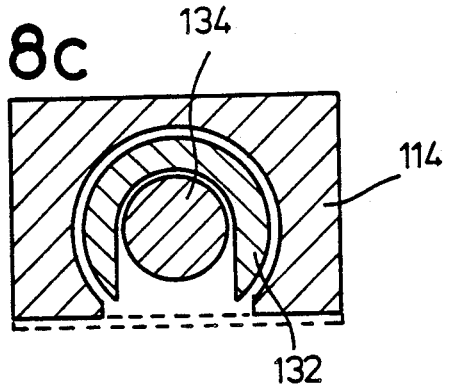
FIGS. 8*a*, 8*b* and 8*c* are cross-sectional views along the lines A—A, B—B, and C—C, respectively.
Figure 8B:
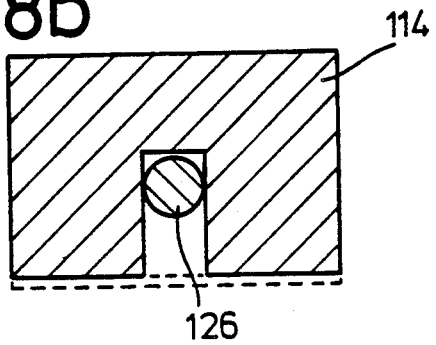
Figure 8A:
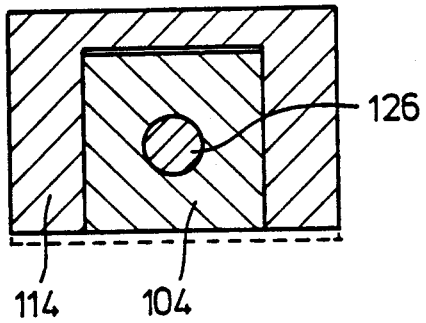

FIGS. 8*a* through 8*c* show cross-section views along the lines A—A, B—B, and C—C of FIG. 7. As indicated by the dotted line, the housing 114, valve seat 104, joint 132, and valve stem 126 are enclosed by a plate. Therefore, such elements can easily be moved after the plate has been removed. This structure facilitates the manual checking of these elements.

The operation of the gas venting device according to the invention now will be described in detail, with reference to FIGS. 5, 6, and 7. FIG. 7 illustrates the configuration of the device when cylinder 116 is pressurized to drive valve stem 126 forwardly to force valve body 106 to its open position. This typically would be done after the mold has been opened to return valve body 106 to its open position for cleaning and inspection. Before the mold is reclosed cylinder 116 is depressurized which permits the working parts to assume the "check" configuration shown in FIG. 7. As explained above, because of the relative biasing forces of springs 124 and 146, sliding joint 132 assumes its foremost position while drive rod nut 140 abuts the rear shoulder 144 of sliding joint 132. This leaves valve body 126 free to move so the operator can manually check for any obstruction in or around inlet 108 and insure freedom of movement of valve body 106.

FIG. 5 also illustrates the configuration of the device during the melt injection phase, when gases are evacuated through gas vent passage 12, chamber 13, passage 14-14, inlet 108 and exhaust port 110. In this configuration pneumatic cylinder and piston assembly 112, while maintaining valve body 106 in the open position, remains poised to drive valve stem 126 and valve body 106 rearwardly to the closed position when compressed air is supplied to the lower port of cylinder 116. When this occurs (FIG. 6) valve stem 126 and valve body 106 are driven rearwardly at a rapid rate.

As illustrated in FIGS. 5, 6, and 7, the forward face of valve body 106 and the forward end of valve seat 104 are machined at a slight angle to a plane perpendicular to the axis of the valve body and valve stem. This facilitates removal of melt which may have adhered to these surfaces. Cleaning also may involve complete removal of the gas venting device from the portion of the mold to which it is bolted.

In FIGS. 9 through 12, other preferred embodiments of the present invention are illustrated. In the following description, the same elements as appear in the previous embodiments shall be denoted by like reference numerals, so as to facilitate illustration.

As described above with reference to FIGS. 5 through 7, the forward face 106*a* of valve body 106 and the forward end of valve seat 104 are machined at a slight angle to a plane perpendicular to the axis of the valve body and valve stem. However, according to the present embodiments, for example, the forward face 106*a* of the valve body 106 and the forward end of the valve seat 104 are machined to be different from each other in angle of inclination, or a cut off portion may be provided at the forward face of valve body 106 or valve seat 104, for thereby not creating an undercut portion, for ensuring the opening of the die, and for facilitating the extrusion of products with ease.

Figure 9:
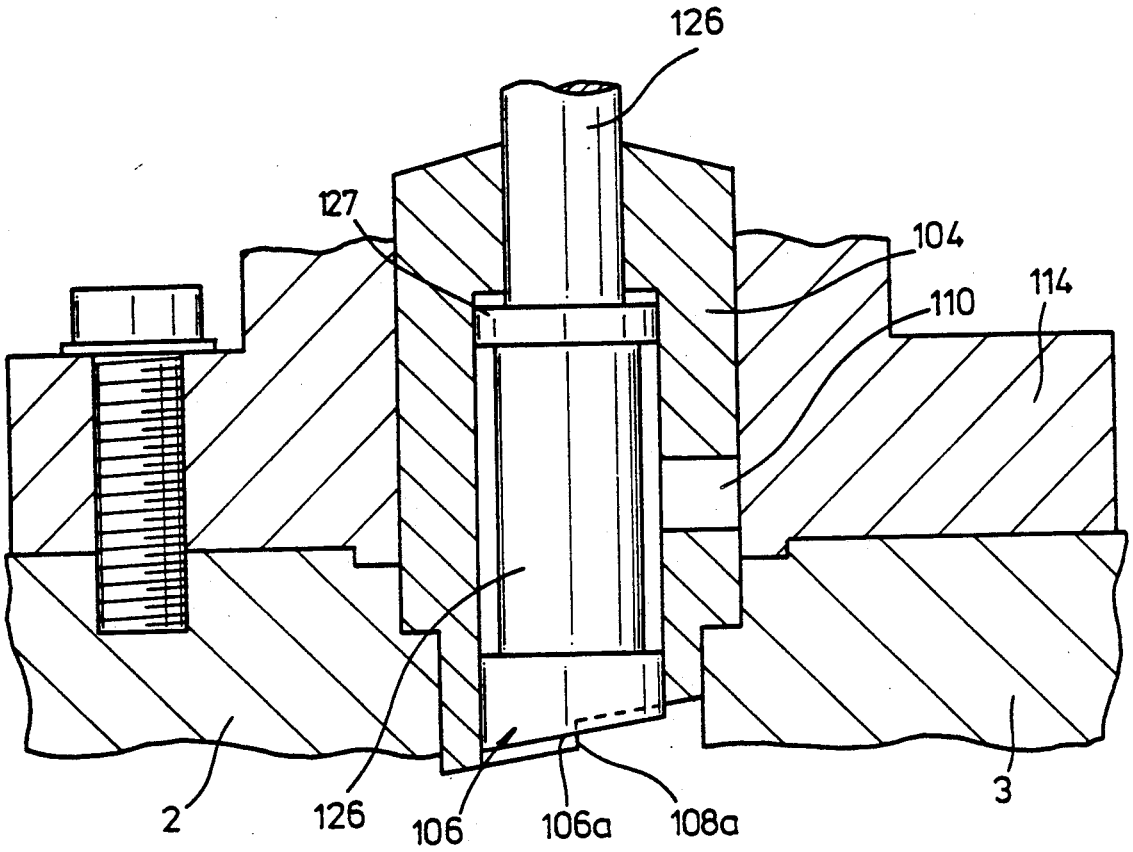
FIGS. 9, 10, 11 and 12 are schematic views of the inlet portions of the valve seat and valve body, respectively, in the present invention.

It has been a problem in the prior art that undercut portions could develop in the die product which could hinder easy removal of the product from the die. For example, as shown in FIG. 9, the movable portion 3 of the die is to be removed whereby the product may be taken out of the die mold. However, if an "undercut," or overhanging portion develops in the hardened melt, this can effectively lock the die closed or lock the product within the die, such that the movable die 3 cannot be opened or the product cannot be easily removed from the die. In the following embodiments, the valve body 106 and valve seat 104 are machined at angles preferentially slanted toward the movable die 3, so that an undercut does not develop in the hardened melt and the die can therefore be easily opened.

As shown in FIG. 9, an inlet portion 108*a* of the valve seat 104 includes a cut-off or step therein. According to this structure, hardened melt can be removed rightwardly after the movable die 3 has been displaced to the right when opening the die. In this situation, the forward face 106*a* of the valve body 106 is almost half-way revealed out of the inlet position 108*a* whilst the remaining half portion of the forward face 106*a* of valve body 106 is just recessed into the inlet portion 108*a*. Accordingly, the die can be easily opened and the product can be easily extracted from the die without any undercut.

Figure 10:
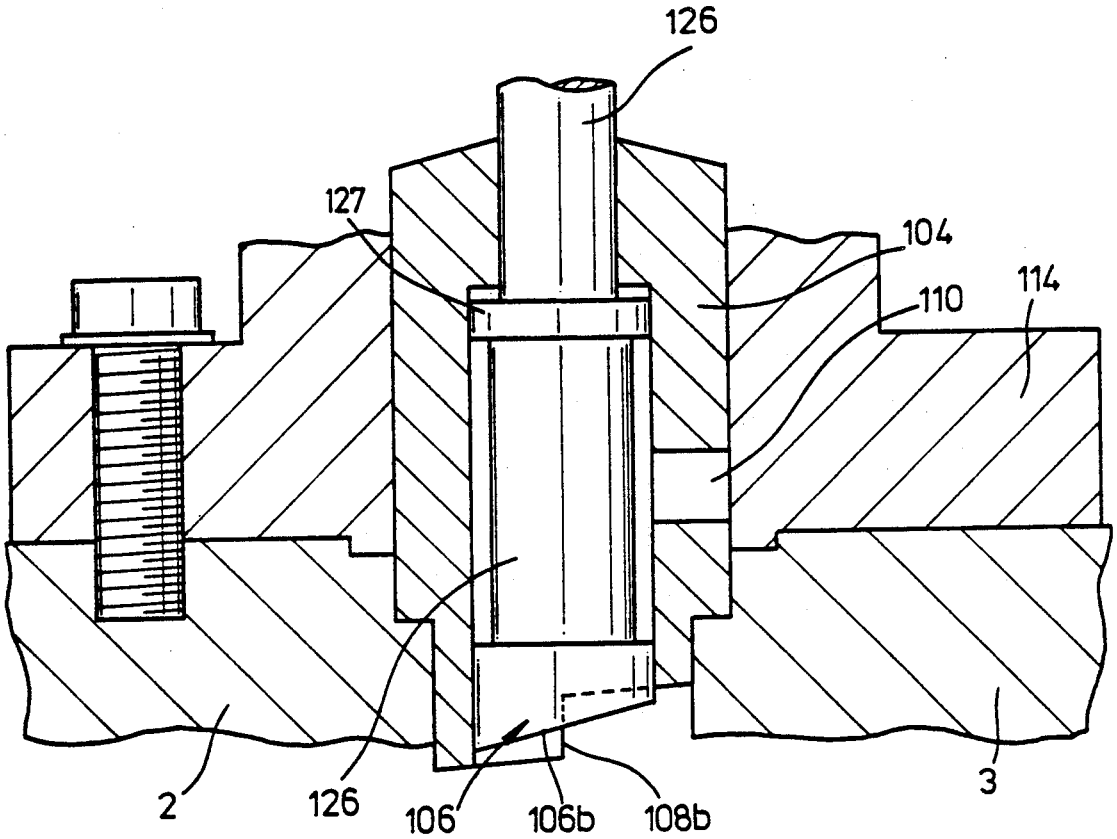

FIG. 10 illustrates another embodiment of the invention in which an inclined angle of forward face 106*b* is different from that of the step of the inlet portion 108*b*.

Figure 11:
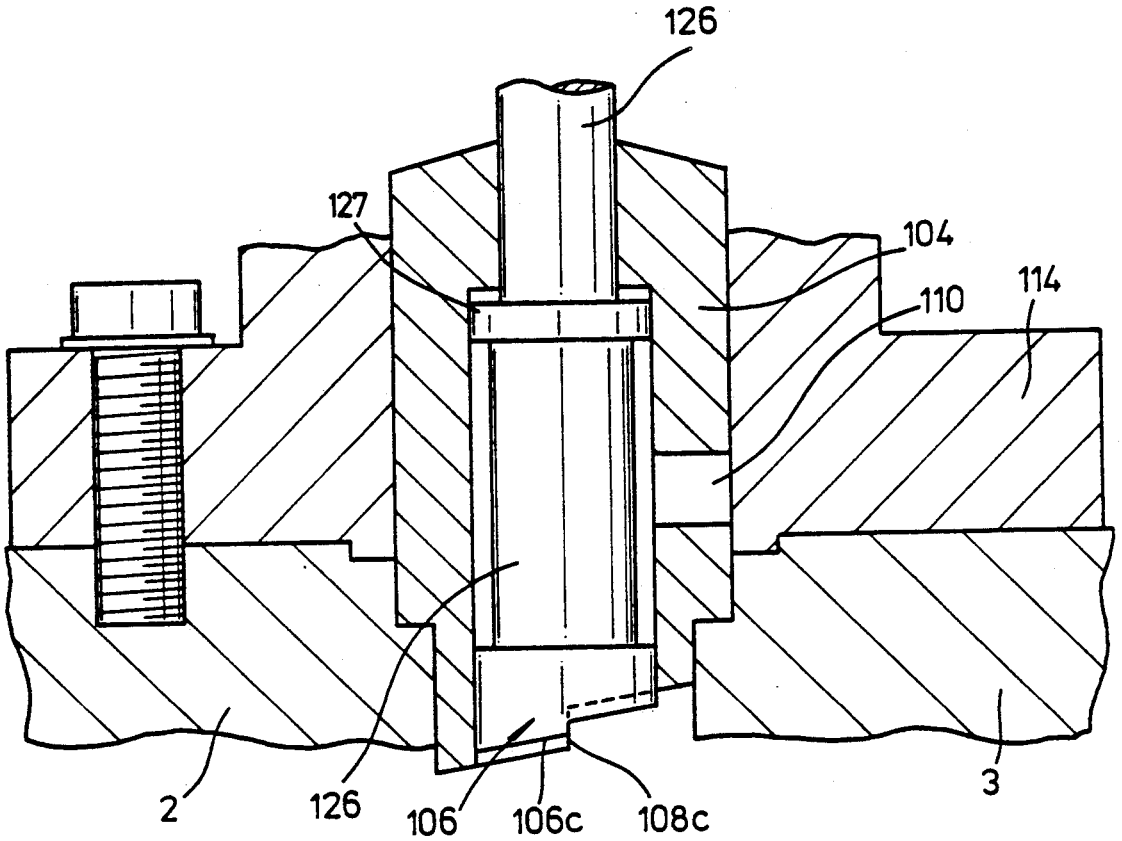

In FIG. 11, a cut-off portion with a step is provided at the forward face 106*c* of the valve body 106. The cut-of portion is machined at an angle which is the same as that of the step of the inlet portion 108*c*.

Figure 12:
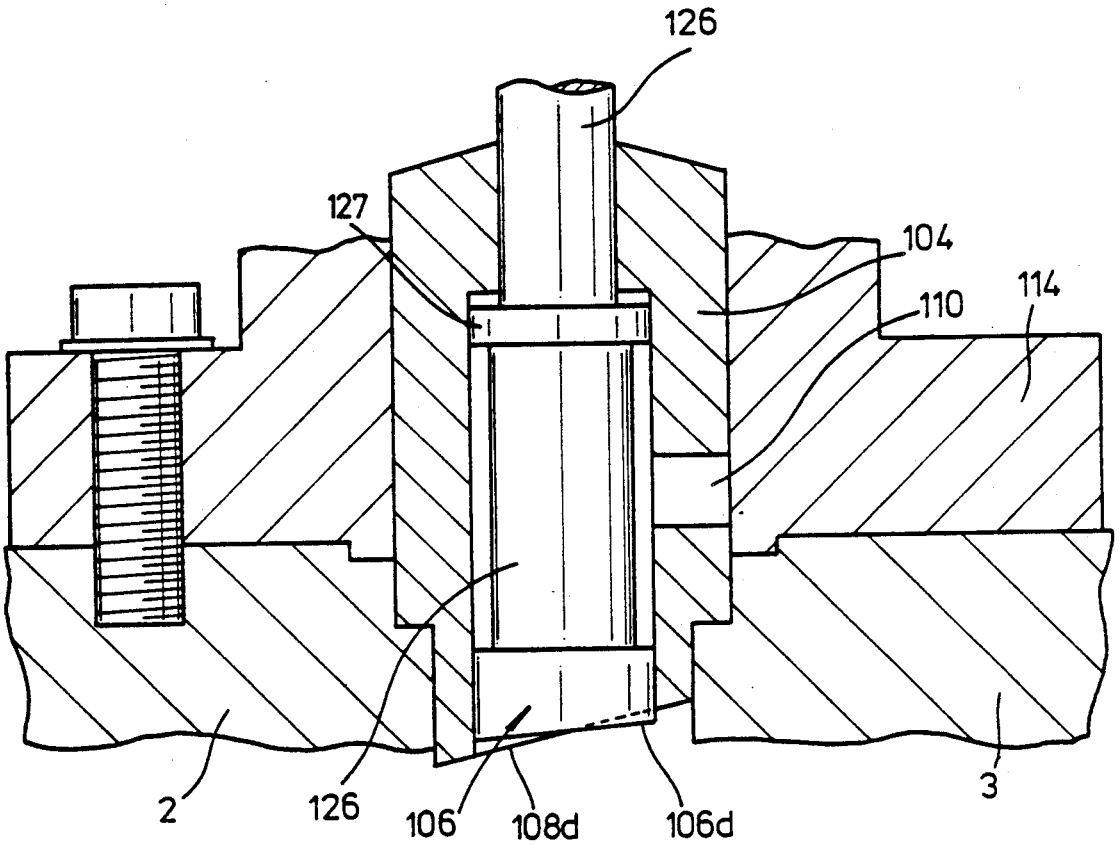

In FIG. 12, the forward face 106*d* of the valve body 106 has a different angle of inclination from the forward end of the inlet 108*d*.

All of the above embodiments shown in FIGS. 10 through 12 perform the same function and have similar advantages to the embodiment of FIG. 9, namely to facilitate opening and removal of the product from the die.

From the foregoing it will be seen the the gas venting device according to the invention efficiently accomplishes its objective. Pneumatic cylinder and piston assembly 112 provides a positive closing force for the valve which helps valve body 106 overcome any obstruction. The ability of valve body 106 to undergo more rapid, melt-driven closure ensures that virtually no melt can find its way through inlet 108 into valve chamber 102. Although disclosed as usable in connection with die-casting operations, the gas venting device according to the invention is equally applicable to other types of molding operations involving gas evacuation, such as the injection molding of plastic or other types of materials. Modifications to the disclosed preferred embodiment will be apparent to those skilled in the art. For example, cylinder and piston assembly 112 may be hydraulically driven, rather than pneumatically actuated. Coupling means other than that illustrated and described in coupling chamber 122 may be provided which performs substantially the same function. Other modifications will be apparent to those skilled the the art without departing from the true scope of the invention which is defined by the appended claims.

We claim:

1. A gas venting arrangement for use with molding apparatus including a mold having a cavity to be filled with a melt, means for injecting melt into the mold cavity and a gas vent passage communicating with the mold cavity for evacuating gas from the mold cavity ahead of advancing melt as it fills the mold cavity, said gas venting arrangement comprising:

a housing having a valve chamber with an inlet adapted to be placed in fluid communication with the gas vent passage, and an exhaust port for evacuating gas from said chamber;

an annular valve seat adjacent said inlet;

a valve body coaxial with said valve chamber and said valve seat and having a valve stem extending rearwardly through said valve chamber away from the mold, said valve body being axially movable forwardly, toward the mold, to open said inlet, and movable rearwardly, away from the mold, to close said inlet in cooperation with said valve seat; and valve actuation means associated with said housing and operatively coupled to said valve stem for positively driving said valve body rearwardly to positively close said inlet when the mold is full of melt, and permitting said valve body to be driven rearwardly more rapidly by the melt itself to close said inlet if melt advancing through the gas vent passage overtakes the positively driven valve body, wherein a forward face of the valve body and a forward end of the valve seat are machined at an angle to a plane perpendicular to the axis of the valve body and valve stem.

2. A gas venting arrangement according to claim 1, wherein said forward end of the valve seat includes a step portion with an angle substantially the same as an inclined angle of said forward face of the valve body.

3. A gas venting arrangement according to claim 1, wherein said forward face of the valve body and a forward end of the valve seat have surfaces with inclined angles that are different from each other.

4. A gas venting arrangement according to claim 1, wherein step portions are provided at said forward face of the valve body and a forward end of the valve seat, respectively, having angles of inclination that are substantially the same.

5. A gas venting arrangement according to any one of claims 1 through 4, wherein said valve stem includes stopper means for thereby preventing the melt and/or dust from entering into said valve activating means.

6. A gas venting arrangement according to claim 5, wherein said stopper means is constructed with said valve stem as an integral body.

* * * * *